US006987711B2

(12) United States Patent
Jolidon

(10) Patent No.: US 6,987,711 B2
(45) Date of Patent: Jan. 17, 2006

(54) ANALOG INDICATOR DEVICE FOR TIMEKEEPING CLOCK AND USE THEREOF

(76) Inventor: Hugues Jolidon, Rue de la Faverge 175, CH-2853 Courfaivré (CH)

( * ) Notice: Subject to any disclaimer, the term of this patent is extended or adjusted under 35 U.S.C. 154(b) by 372 days.

(21) Appl. No.: 10/203,329

(22) PCT Filed: Feb. 6, 2001

(86) PCT No.: PCT/CH01/00083

§ 371 (c)(1),
(2), (4) Date: Aug. 6, 2002

(87) PCT Pub. No.: WO01/59530

PCT Pub. Date: Aug. 16, 2001

(65) Prior Publication Data

US 2003/0021190 A1 Jan. 30, 2003

(30) Foreign Application Priority Data

Feb. 7, 2000 (CH) ..... 0243/00

(51) Int. Cl.
*G04B 19/00* (2006.01)

(52) U.S. Cl. ..... 368/77; 368/68; 368/79

(58) Field of Classification Search ..... 368/76–77, 368/220–221, 228, 232–234, 238–239
See application file for complete search history.

(56) References Cited

U.S. PATENT DOCUMENTS 2,437,621 A * 3/1948 Strate ..... 235/78 R
3,557,547 A * 1/1971 Rejminger ..... 368/101

FOREIGN PATENT DOCUMENTS

| | | |
|---|---|---|
| DE | 3503672 | 8/1986 |
| DE | 3907873 | 11/1989 |
| EP | 0365443 | 4/1990 |
| GB | 2206712 | 1/1989 |

OTHER PUBLICATIONS

International Search Report No. PCT/CH01/00083 of Apr. 18, 2001.

* cited by examiner

*Primary Examiner*—Vit Miska
*Assistant Examiner*—Jeanne-Marguerite Goodwin
(74) *Attorney, Agent, or Firm*—Ostrolenk, Faber, Gerb & Soffen, LLP

(57) ABSTRACT

The invention concerns a timekeeping clock wherein on the axis of a mobile counter completing a cycle in 11 seconds is mounted a transparent disc (42) bearing (11) radial markers (44). The dial positioned beneath the disc (41) provides a marking in the form of a marker circle (40) with (10) radial markers (41) numbered 0, 1, 2, 3, 4, 5, 6, 7, 8, 9. At each step of the mobile disc successive alignments occur between a marker of the disc (42) and a marker of the ring (40) thereby enabling tenths of seconds elapsed to be displayed anticlockwise.

12 Claims, 9 Drawing Sheets

ANALOG INDICATOR DEVICE FOR TIMEKEEPING CLOCK AND USE THEREOF

BACKGROUND OF THE INVENTION

The present invention relates to an analog indicator device for timekeepers and the application of the device.

Up to now, chronographs and chronograph watches have been manufactured in various forms that mainly distinguish themselves by the appearance of the control and display elements, the employed materials, their aspect, etc. Generally, these timekeepers comprise a so-called trotteuse or direct-drive seconds-hand that is driven at a period of one turn per minute and may be stopped at will in order to read the measured time. Generally, the dial includes divisions indicating subperiods corresponding to seconds. Fractions of the subperiods can be read with an accuracy of approximately one-fifth of a second if the balance and spring system oscillates at 18,000 vibrations. For optical reasons, a higher reading precision is hardly possible, even in timekeepers having a higher than customary frequency. In certain cases, in addition to the second-hand indicating the number of elapsed seconds, the chronograph comprises counters, e.g. a minute or hour counter, for counting the elapsed minutes or hours.

A device making use of the vernier principle in order to display hours and minutes merely by means of the hour wheel is described in German Patent DE 39 07 873 A. The aim of this device is to reduce the number of indicators, more particularly to omit the minute hand, thereby allowing reduction in the energy consumption of the movement. To this end, the dial includes five areas in the form of concentric circular crowns on each of which eleven equidistant references are arranged, thus obtaining 55 equal circular sectors while each of the references of a given area is offset from the nearest mark of the (two) adjacent area(s) by an angle of 6.5°. An hour wheel in the form of a disk on top of the dial also includes five concentric circular areas on each of which twelve equidistant slots are arranged, thus obtaining 60 equal circular sectors while each of the slots of a given area is offset from the nearest slot of the adjacent area(s) by an angle of 6°. The arrangement of the device allows reading of coincidences separated from each other by 65.45 seconds in the clockwise direction. In order to obtain coincidences separated by 60 seconds, the hour wheel would have to be driven at a period of one turn in eleven hours, thereby falsifying the hour reading.

EP 0 365 443 A2 describes an hour display system composed a moving disk and of a concentric fixed disk, thereby also allowing to read hours and minutes on the hour wheel only. The coincidences are read by juxtaposing the successive marks in the clockwise direction according to the vernier principle. This system requires a counterclockwise numbering of the hour marks on the hour wheel. Furthermore, the user must become familiar with handling and reading a vernier, whereas the hour reading is not only untypical, but first of all difficult and uncomfortable.

SUMMARY OF THE INVENTION

The object of the present invention is to eliminate the drawbacks of the known devices, more particularly to adapt the vernier principle in such a manner as to allow a precise and easy reading of subperiod fractions in a clockwise or counterclockwise direction independently of the rotational direction of the moving indicator, and without requiring any knowledge of the vernier principle on the part of the user.

The invention provides an analog indicator device for timekeepers, having at least one reading assembly formed of a principal reading pair made up of a fixed reference member having a reference graduation comprising equidistant marks, and a moving indicator member provided with at least one reference that moves with respect to the fixed reference member with a basic period Pb defining a given number and duration of subperiods per passage of the reference with regard to the marks of the reference graduation. The two members of the pair each have a subperiod reading graduation. These two graduations are disposed according to the vernier principle. The subperiod reading graduations are disposed so that when the moving member is stopped in any position, the graduations allow a precise reading of a time interval corresponding to a subperiod fraction elapsed since a last coincidence between the position of the reference and a mark of the reference graduation. The arrangement of the subperiod reading graduations on the two members allows a reading of successive coincidences in the clockwise or counterclockwise direction independently of the rotational direction of the moving member.

In another embodiment, the moving member is provided, on one hand, with a principal reference that allows reading of the subperiods, and on the other hand, with a number of auxiliary references corresponding to the number of subperiods. The fixed member of the pair comprises a graduation extending on a circular arc and including a number of fixed auxiliary references that correspond to a desired number of readable subperiod fractions. Each reference of the moving member passes through the graduation of the fixed member so that when stopped, the position of an auxiliary reference in front of the fixed graduation allows reading of the elapsed subperiod fraction.

In still a further embodiment, the reading pair comprises, on the moving member, an opaque circular crown that is subdivided into elements whose length is equal to the subperiods by transparent radial marks whose width corresponds to the subperiod fraction to be read. The fixed member of the pair comprises a crown disposed under the crown of the moving member. The fixed member crown has an arc portion divided into pairs of alternating dark or opaque and light elements. Each pair of the dark and light elements covers an arc that corresponds to the subperiod marked by the moving member. The ratio between the dark and light elements varies from one pair to a following pair by an amount that corresponds to the subperiod fraction to be read.

Another embodiment provides that the graduation of the fixed member of the pair extends on an arc that corresponds to a product of a desired number of readable subperiod fractions by a step of one subperiod on the moving member. The number of pairs of light and dark elements also corresponds to the desired number of readable subperiod fractions in each subperiod.

In yet another embodiment, the subperiod fractions are indicated on an auxiliary reading pair that is distinct from the principal reading pair. The indicator member of the auxiliary pair has a rotation period equal to a product of the duration of the subperiod of the principal pair and a desired number of readable subperiod fractions plus one or less one.

In a further refinement, the members of the auxiliary reading pair each comprise a crown divided by radial elements into regular segments whose number is equal, for one of the members, to the number of subperiod fractions to be read, and for the other member, to that number plus or less one. The disposition is such that in every stopping position, the superposed and non-coinciding elements become invisible due to superposition of opaque or dark and of light or transparent portions, whereas only two coinciding elements, one of which is transparent and located on the moving member, and the other one of which is light and located on the fixed member, are visible and indicate by their position the duration of the subperiod fraction to be read.

Additionally, the light or transparent portions can have a width that corresponds to the duration of the subperiod fractions to be read.

Another embodiment of the invention provides that the principal reading pair is composed of the indicator member and of the reference member for division of a period Pb into subperiods. The indicator member is provided with a single reference. An auxiliary reading pair is provided that is composed of an indicator member and a reading member that divide the subperiods into fractions, whose period corresponds to a sum of the number of subperiod fractions, and permit, when stopped during a subperiod, to read an elapsed time since a last coincidence between a reference of the fixed member and the reference of the moving member of the principal reading pair due to disposition of the subperiod reading graduations on the auxiliary reading pair.

BRIEF DESCRIPTION OF THE DRAWINGS

Different embodiments and different variants of the object of the invention will be described hereinafter by way of example and with reference to the accompanying drawing, where.

DETAILED DESCRIPTION OF THE INVENTION

Figure 1:
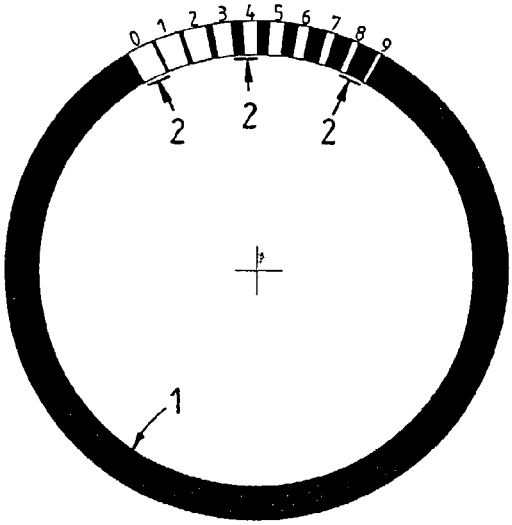
FIGS. 1, 2, 3 are top plan views of the fixed member, of the moving member and of superposed positions of the two members of a reading pair according to the first variant of the first embodiment.
Figure 7A:
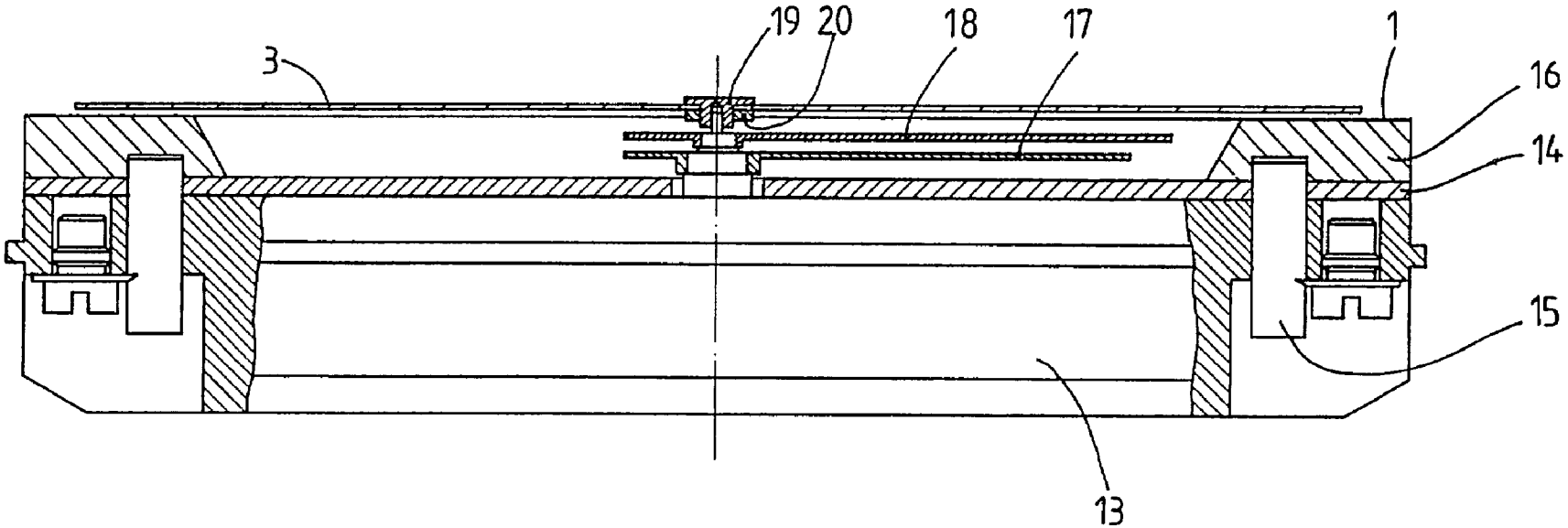
FIG. 7*a* is a schematic cross-sectional view of a chronograph using either one of the variants of the first embodiment.

In the examples described hereinafter, the indicator device is incorporated in an analog chronograph with a mechanical movement which is schematically represented in FIG. 7*a*. The visible upper surface of this chronograph comprises a circular dial with a flange 16 mounted thereon, of which FIG. 1 shows the marking constituted by a crown 1 which is centered on the axis of the hands and whose width is constant on its entire circumference. Between the 11 h. and the 1 h. positions the dark-coloured crown 1 is provided with alternating light and dark areas that divide the circular arc from 11 h. to 1 h. into 10 pairs of alternating dark and light elements (2). The ratio between the widths of the areas of each pair progressively varies from one end of the circular arc to the other. The details of the disposition will be described later on with reference to FIG. 7*b*.

Figure 2:
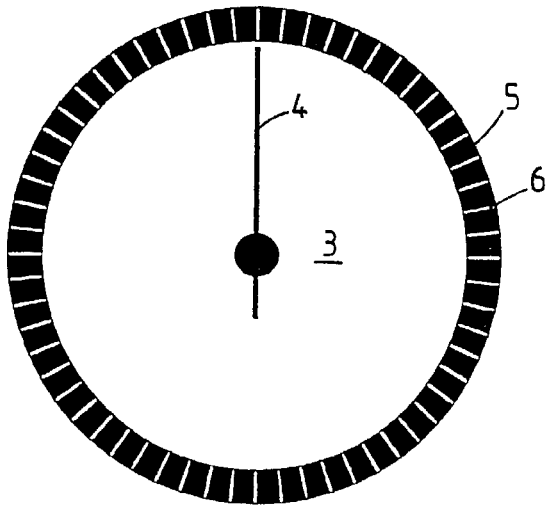

FIG. 2 represents a transparent disk 3 intended to be mounted on the axle of the second-hand of the chronograph in such a manner as to be superposed to the crown 1 of the flange 16. It bears a radial marking line 4 representing the second hand, as well as an opaque circumferential crown 5 formed of 60 distinct elements separated by radially traced transparent spaces 6 of a width of 0.6 arc degrees, i.e. a tenth of the space traversed by the disk 3 in a second. Preferably, the markings 5 and 6 will be produced by screen printing on the inner side of the disk 3, whereas the marking 4 may be provided on the upper side or on the underside of the disk.

Figure 3:
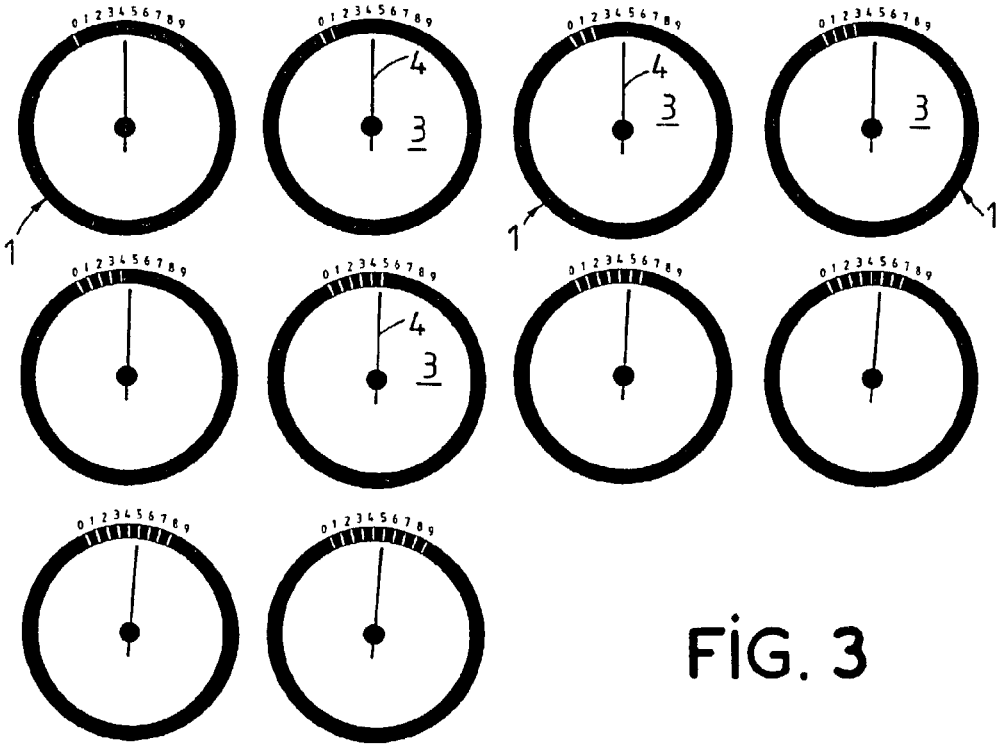
Figure 7B:
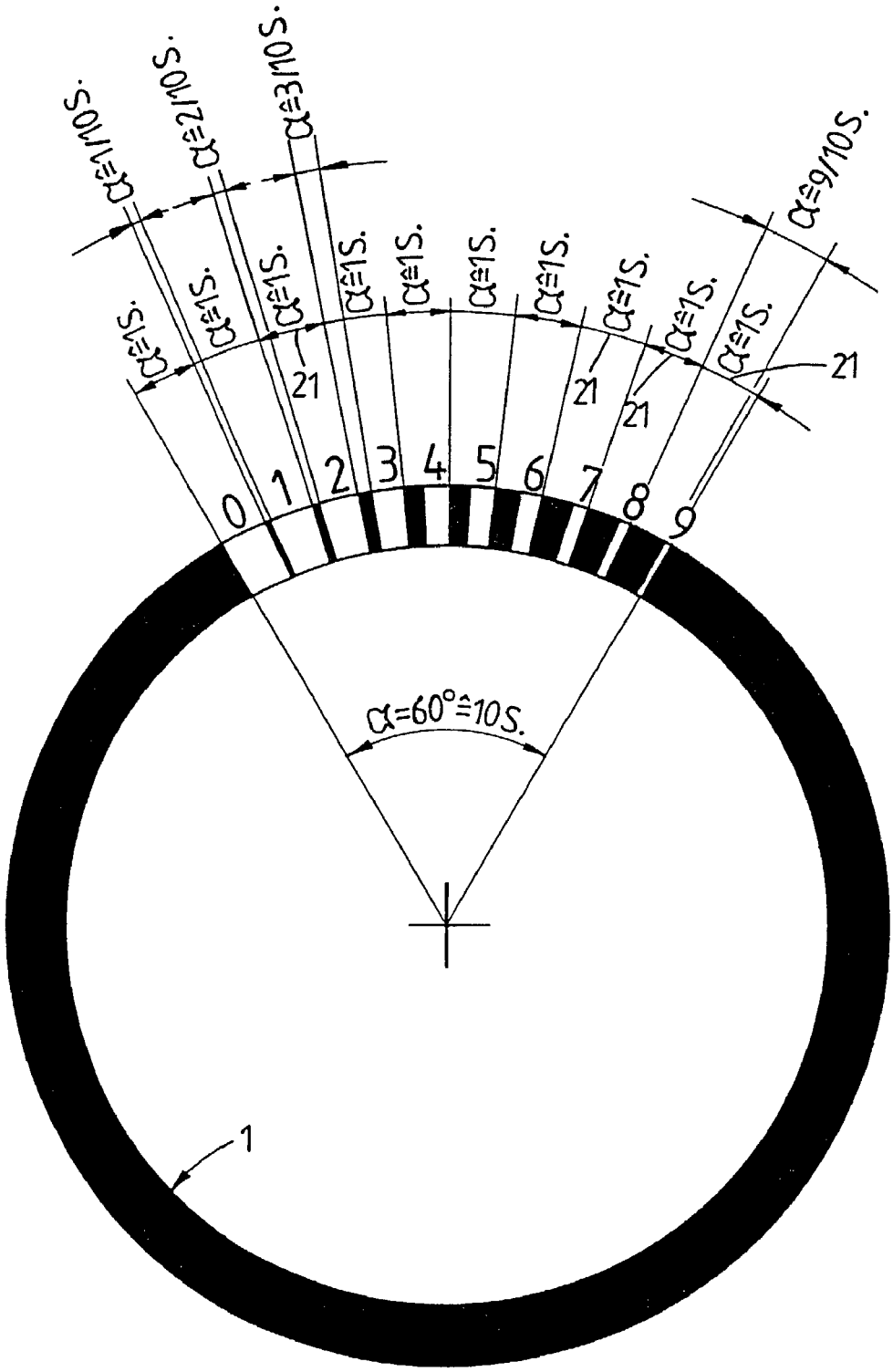
FIGS. 7*b* and 7*c* are top plan views on an enlarged scale of the fixed member of the first and second variants of the first embodiment.

FIG. 3 shows the 10 successive positions of the disk 3 on the crown 1 of the flange 16 during the second following the start of the chronograph from the zero position. At the beginning, one element 6 is visible in front of the first light area of elements 2 on the flange, but with each tenth of a second, another element 6 is positioned in front of a light area of the flange, so that when the hand is stopped during the first second, it is possible to read the number of tenths of seconds that have elapsed. The operation of this system will be explained in more detail below (FIG. 7*b*). It will be noted here that with the system of FIGS. 1, 2, 3, the marking of the tenths of seconds develops in the clockwise direction, as that of the seconds.

Figure 6:
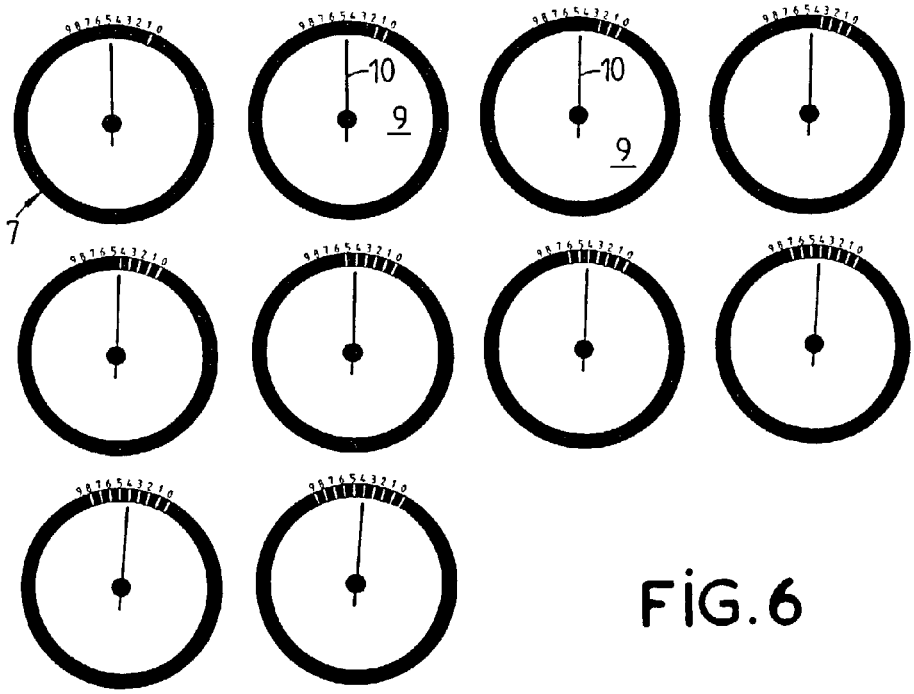

In the same manner as FIGS. 1, 2, 3, FIGS. 4, 5, 6 represent the crown 1 of the flange 16 of a chronograph, provided with a dark circular marking 7 and a series of alternating elements 8 forming light and dark areas on the circular arc between 11 h. and 1 h. A transparent seconds disk 9, is provided with a linear radial marking 10 representing the second hand and with a crown of opaque elements 11 separated by transparent radial spaces 12 that are identical to those of the disk 3 of the first variant. The dark circular marking 7 and the seconds disk 9 form a reading pair. The various relative positions of the two components 7, 9 of the reading pair 7, 9 as represented in FIG. 6 show that the display of the tenths of seconds develops in the counterclockwise direction while the seconds disk rotates in the normal clockwise direction.

FIG. 7*a* shows the chronograph in a schematic sectional view. The movement 13 carries a dial 14 fastened by means of feet 15 that project from the top surface and a centre flange 16 whose plane upper surface forms the crown 1. Hour and minute hands 17 and 18, respectively, are mounted on the pipes of their respective wheels and pinions. They extend in the space that is limited by the flange 16, whereas the circumference of the disk 3 of the seconds member extends immediately above the upper surface of the flange 16, so as to reduce the parallax to a minimum. A tube 19 and a washer 20 ensure the retention of the disk 3 on the shaft of the seconds wheel. The means for starting and stopping the disk 3 and for its return to zero are conventional means and are not represented in FIG. 7*a*.

Figure 7C:
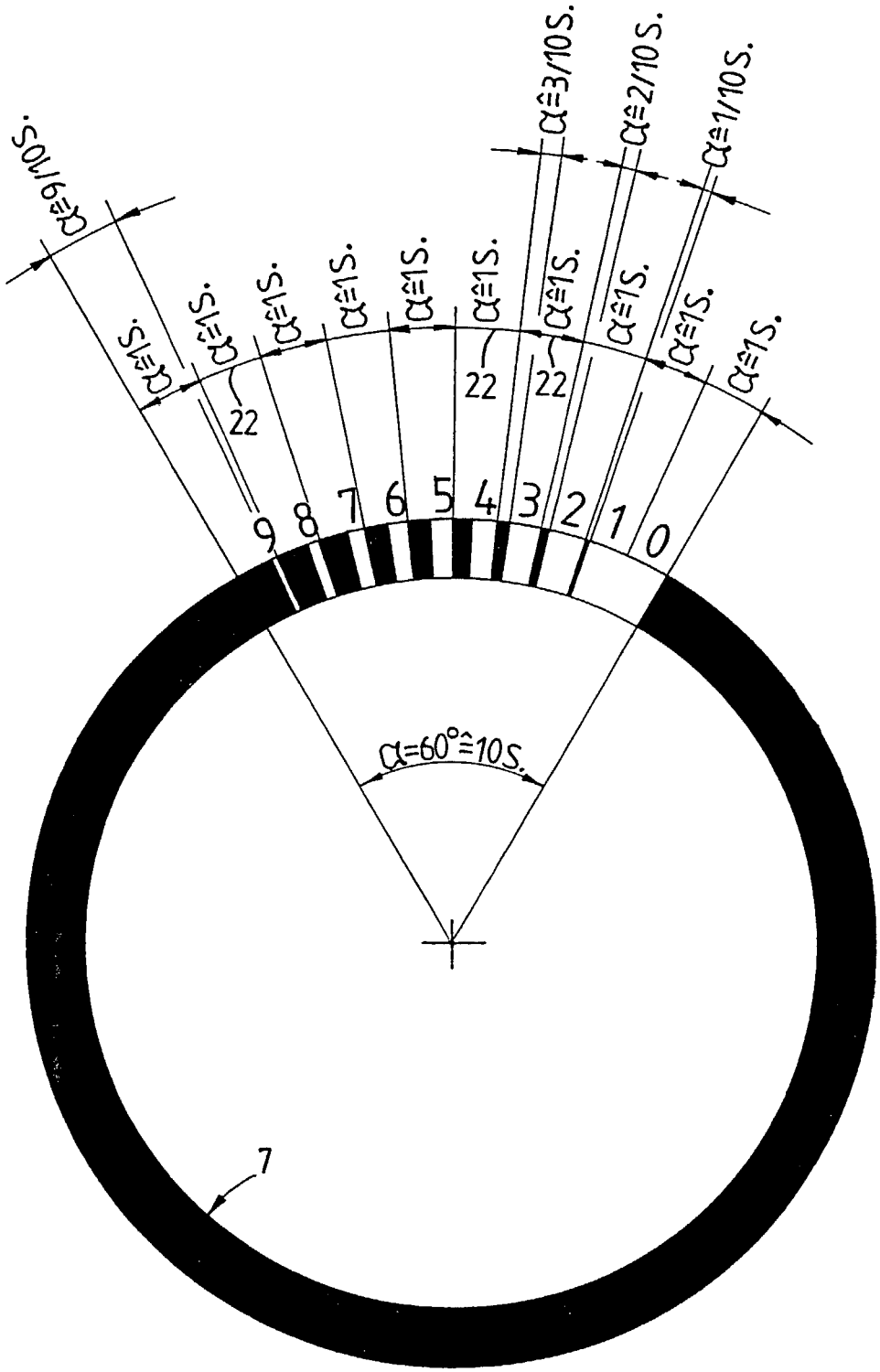

FIGS. 7*b* and 7*c* again illustrate the disposition of the portion of the crown 1, 7 on the arc comprised between 11 h. and 1 h. for the first and the second variant of the first embodiment in more detail. In FIG. 7*b*, which corresponds to FIG. 1, this arc covers 60 degrees and is divided into 10 elements 21 of 6 degrees each, each element being in turn divided into a pair of alternating light and dark areas. The width of the light areas diminishes as seen in the clockwise direction of the circular arc, namely from 6 to 0.6 degrees, whereas the dark areas proportionally increase from 0 to 5.4 degrees. Under these conditions, the progressive displacement of the crown 5 of FIG. 2 above the crown 1 of FIG. 1 causes the succession of markings as represented in FIG. 3 to appear once every second.

Figure 4:
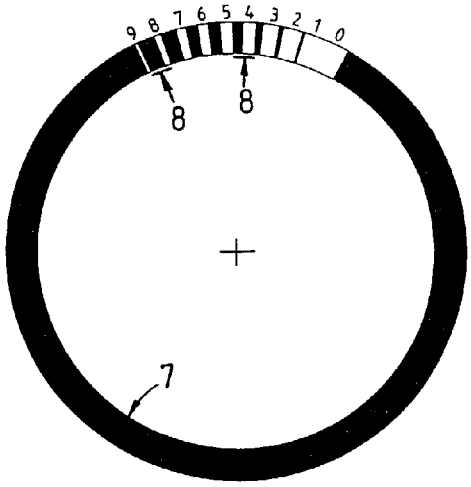
FIGS. 4, 5, 6 are similar views of the members of a reading pair according to the second variant of the first embodiment.
Figure 5:
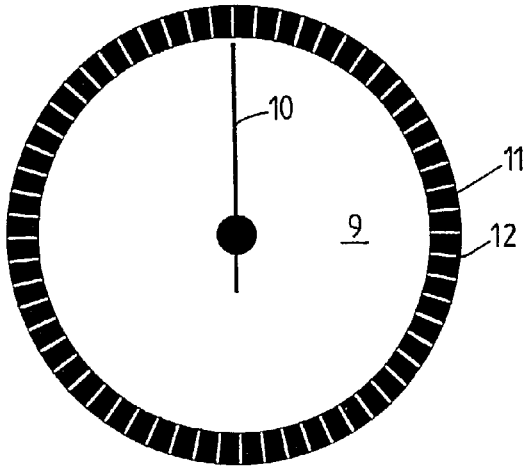

FIG. 7*c* corresponds to FIG. 4. Arc elements 22 of 6 degrees in width are each formed of a dark and of a light area, the dark areas diminishing from 5.4 degrees to zero between the 11 h. position and the 1 h. position. It is understood that the displacement of the crown 11, 12 of disk 9 illustrated in FIG. 5 produces the succession of aspects shown in FIG. 6, where the apparition of the marks develops in the counterclockwise direction, once every second.

Figure 8:
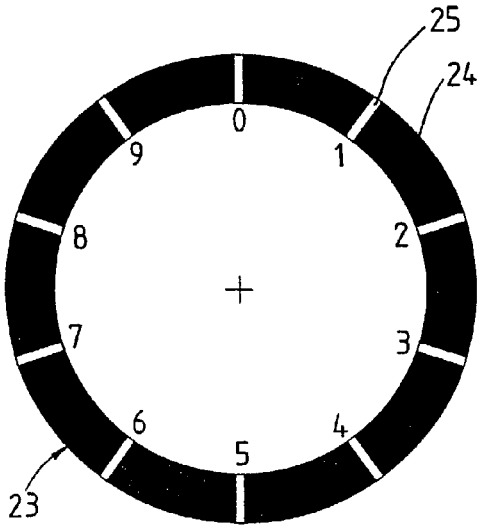
FIGS. 8, 9, 10 are views in analogy to FIGS. 1, 2, 3 showing a first variant of a second embodiment of the device.
Figure 9:
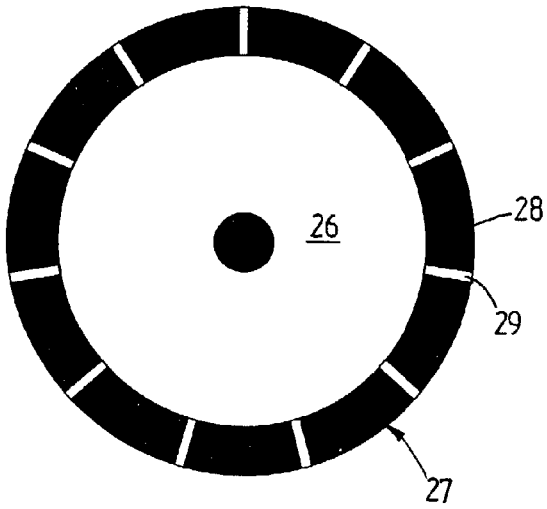
Figure 10:
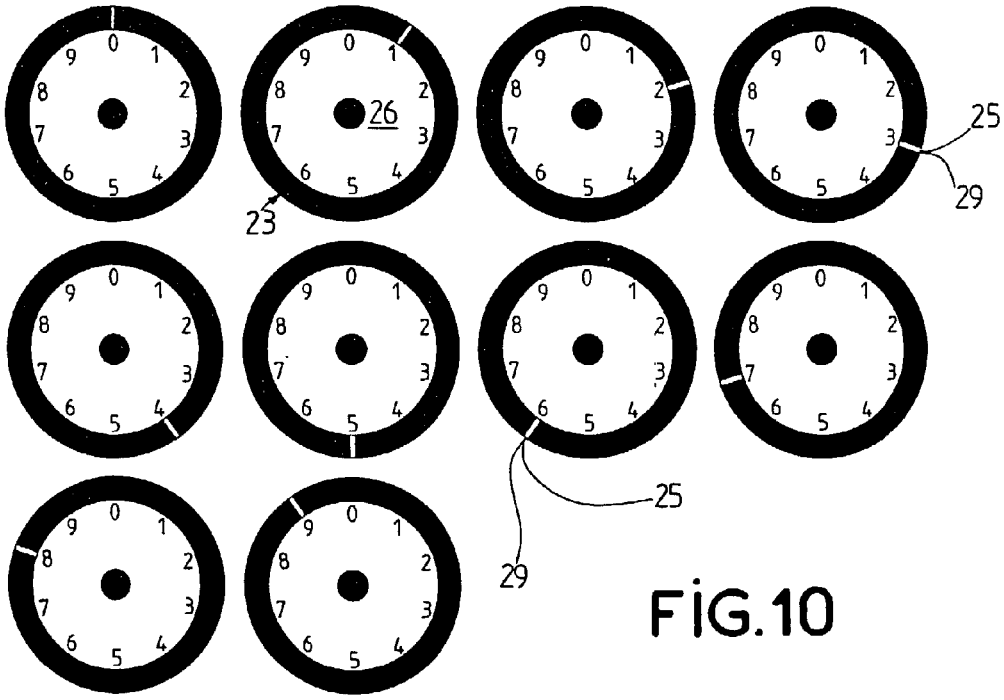
Figure 11:
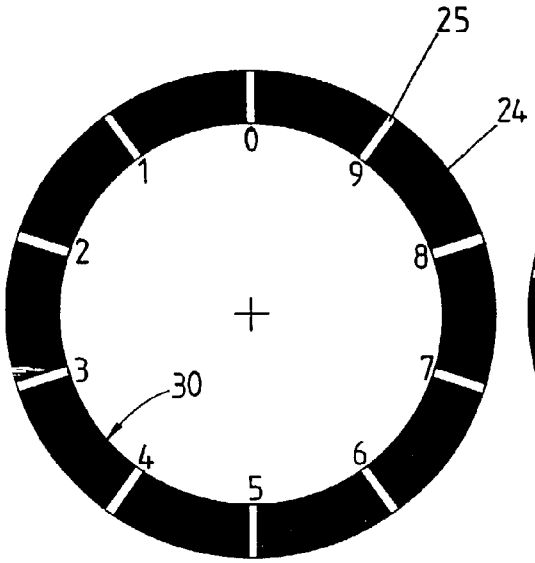
FIGS. 11, 12, 13 are views in analogy to FIGS. 8, 9, 10 illustrating a second variant of the second embodiment.
Figure 12:
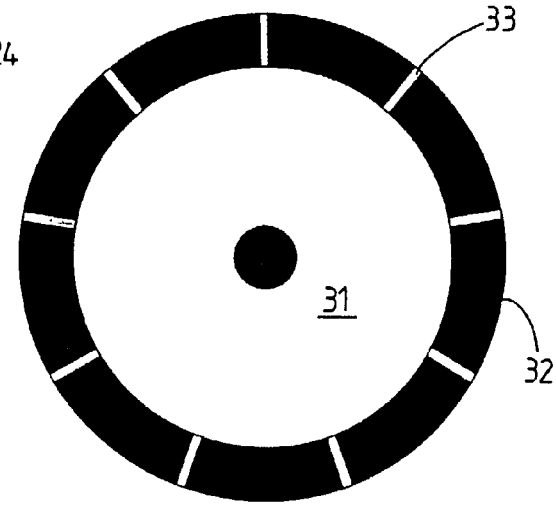
Figure 13:
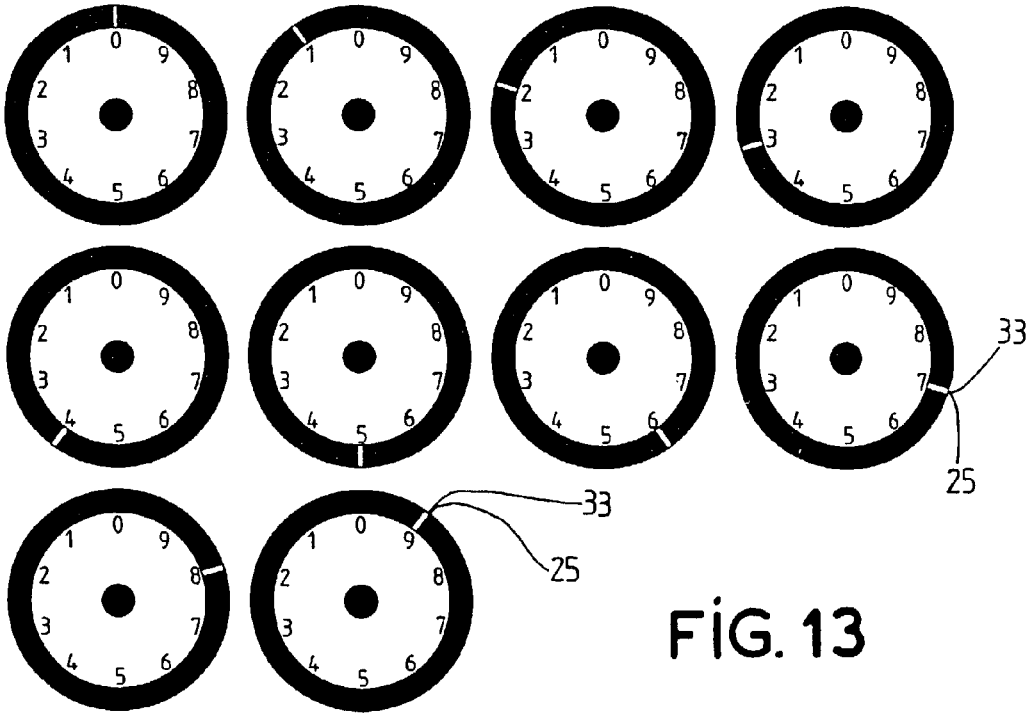
Figure 14:
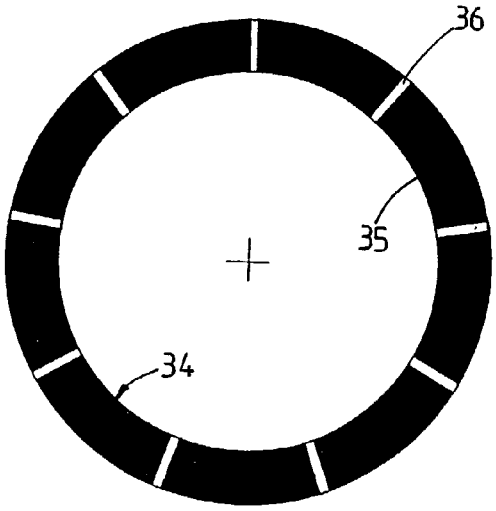
FIGS. 14, 15, 16 are views in analogy to FIGS. 8, 9, 10 illustrating a third variant of the second embodiment.

FIGS. 8 to 19 are partial views illustrating a second and a third embodiment of the device. The latter is used in a chronograph equipped with one or a plurality of counters, this counter or one of these counters being intended for counting the tenths of seconds while the direct-driven second-hand moves normally above the dial. The counter of the tenths of seconds may be located in any one of the four usual positions, i.e. 3 h., 6 h., 9 h. or 12 h. FIGS. 8, 11, and 14 illustrate the marking of the reading member, FIGS. 9, 12, and 15 that of the display member, and FIGS. 10, 13, and 16 the superposition of the two members in the first, second and third variant of the second embodiment.

In the variant of FIGS. 8 to 10, the fixed crown 23 comprises 10 dark elements 24 covering each a little less than 36 degrees and separated by light elements 25 whose width forms the complement to 36 degrees. The exact width of these light elements may be chosen at will for easy reading. Likewise the transparent disk 26 illustrated in FIG. 9 is provided with a crown 27 formed of 11 arc elements 28 of a little less than 360/11 degrees, of opaque colour, which are separated by narrow spaces 29 of the same width as the spaces 25. In this variant, the movement of the chronograph will comprise a wheel rotating at the speed of one turn in 11 seconds, connected to the seconds wheel in such a manner that it is started, stopped, and returned to zero at the same time as the hand of the chronograph. Thus, the superposition of members 27 and 23 will produce the aspects of the various reading positions represented in FIG. 10. The tenths of seconds are read in the clockwise direction.

Fixed crown 30 of FIG. 11 is exactly the same as that of FIG. 8, except for the direction of the markings (which are inverted with respect to each other). It is divided into 10 dark-coloured arc elements 24 which are separated by light-coloured narrow elements 25. As a reference member, it cooperates with a moving reading member 31 in the form of a transparent disk that is mounted on a counter axle rotating, in this variant, at a speed of one turn in 9 seconds. Disk 31 is provided with a crown formed of 9 dark arc elements 32 each covering, together with the following light intercalary element 33, an arc of 40 degrees. As in the preceding variant, the width of the elements 33 will be equal to that of the elements 25. The superposition of the elements 30 and 31 produces the succession of positions shown in FIG. 13: it appears that the marking of the tenths of seconds develops in the counterclockwise direction.

Figure 15:
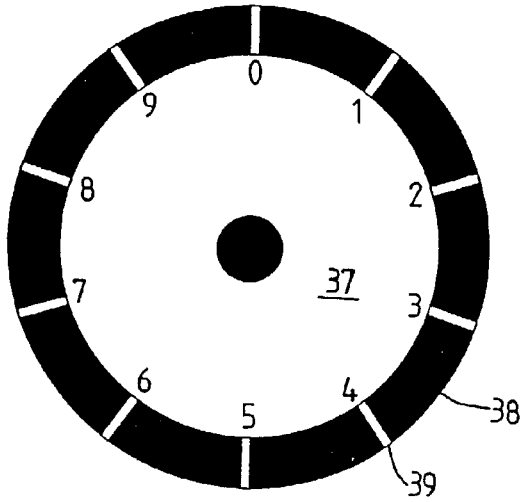
Figure 16:
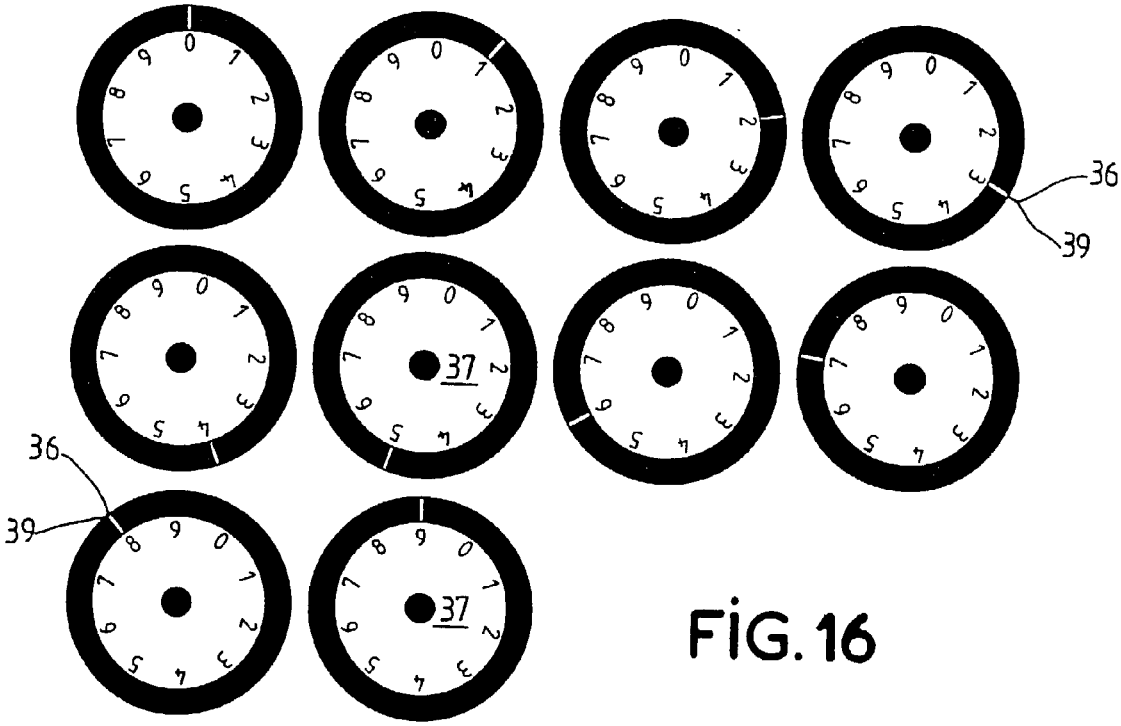

Other dispositions are also possible. Thus, FIGS. 14 to 16 show a third variant of the second embodiment. Here, the fixed reference member is a crown 34 divided into 9 dark-coloured arc elements 35 separated by narrow light elements 36, whereas the moving reading member is a transparent disk 37 provided with a crown of the same diameter and width as the crown 34 and formed of 10 dark elements 38 that are separated by transparent spaces 39 of the same width as the elements 36. Disk 37 is to be mounted on a counter wheel axle rotating at a rate of one turn in 9 seconds, and the superposition of the positions of the two members of the reading pair will produce the appearance of a mark moving in the clockwise direction at a speed of one turn per second, thereby indicating the count of the tenths of seconds.

Figure 17:
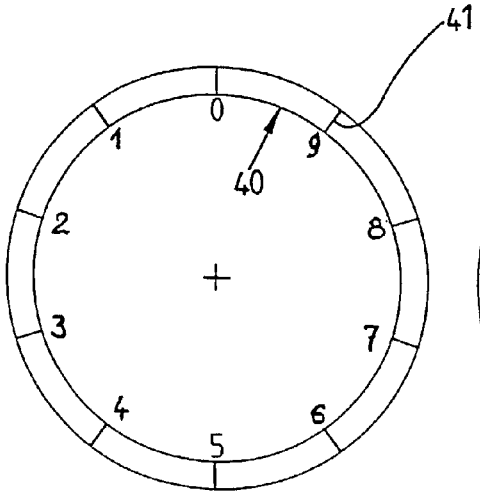
FIGS. 17, 18, 19 are views in analogy to FIGS. 8, 9, 10 illustrating a third embodiment of the device of the invention.
Figure 18:
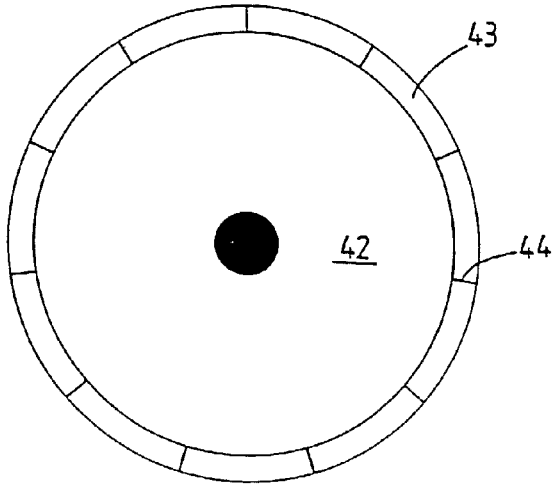
Figure 19:
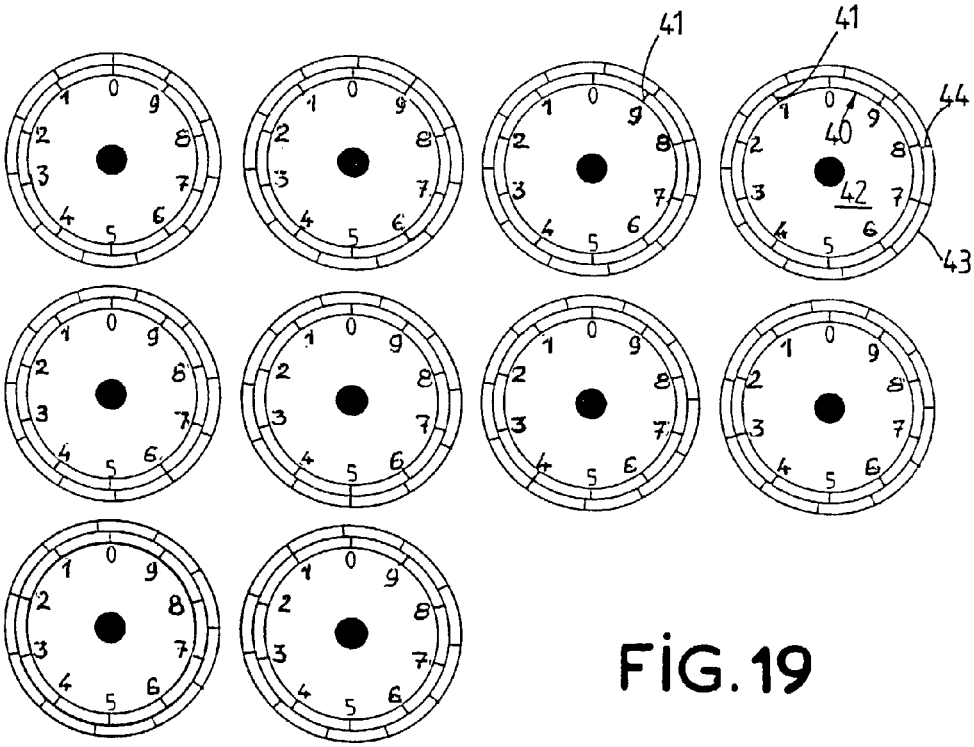

Ultimately, the display of the tenths of seconds may also be obtained as shown in FIGS. 17 to 19, i.e. by means of a fixed, circular reference member 40 comprising 10 marks 41 spaced apart 36 degrees, and by means of a transparent reading member 42 rotating above the member 40 and provided with a crown of marks 43 surrounding the crown of the member 40. In FIG. 18, the crown 43 is divided into 11 segments by 11 radial marks 44 at regular intervals of 360/11, i.e. approximately 32.7 degrees. Every step of the moving disk results in 10 successive coincidences between a mark 44 of the disk 42 and a mark 41 of the crown of the member 40, thereby allowing to determine the elapsed tenths of seconds.

The position of the coincidences between a mark 44 and a mark 41 indicates the tenths of seconds, as appears in FIG. 19. The positions of coincidence develop in the counterclockwise direction.

Thus, the basic period Pb (e.g. the minute) is divided into subperiods (e.g. into seconds), and the latter are in turn divided into fractions of N subperiods (N being e.g. equal to 10, in which case the subperiod fraction is a tenth of a second). Also, as mentioned, an object of the invention is to allow a high reading precision. The precision is at least equal to a time interval corresponding to a fraction N of the subperiod elapsed since the last coincidence between the position of the mark and a mark of the marking graduation. Therefore, explained on the basis of the first embodiment, if the reading precision is to be at least equal to the value of that subperiod fraction (i.e. a reading precision to the N-th at least), the transparent spaces traced radially on the moving disk must extend over a defined angular distance: in fact, the latter must be equal, at the most, to the angular distance covered by the moving disk in 1/N-th of the subperiod, on one hand, and on the other hand, to the progression step (1/N) of the light or dark areas on the disk of the fixed organ having a division of N subperiods. Thus, assuming that N=10, the device allows a reading precision of a tenth of a second at least.

The same reasoning is applicable analogously to the second and the third embodiment.

The various arrangements represented particularly in FIGS. 8 to 16 allow a clockwise succession of the coincidences independently of the rotational direction of the wheel. This characteristic is of interest when the tenths of seconds are read on a separate counter. In fact, depending on the construction of the system of transmission from the center second-hand to the reading wheel of the fractions of subperiods, the rotational direction of the latter might be counterclockwise, thereby requiring an additional wheel. However, it is precisely the above-mentioned characteristic of the invention that allows to avoid such an addition and the consequent drawbacks for the device (higher costs and increased space and energy consumption).

In order to avoid excessive leaps of the moving organ, which might result in reading errors, it is advantageous to choose a balance and spring pair oscillating at 28'800 vibrations at least. Since the duration of the vibration of such a balance and spring assembly is ⅛ of a second, the resulting error never exceeds a value greater than half a subperiod fraction of a tenth of a second.

It is understood that still other dispositions of the described pairs of reading elements are conceivable, particularly with respect to their colours or to the general aspect of the opaque or dark areas and their superposition on the visible surface of the timekeeper.

Ultimately, it will be noted that an indicator device as described above may be integrated in a conventional watch with or without a second-hand for the sole purpose of creating an evolutive decorative effect.

What is claimed is:

1. An analog indicator device for timekeepers, comprising at least one reading assembly formed of a principal reading pair made up of a fixed reference member having a reference graduation comprising equidistant marks, and a moving indicator member provided with at least one reference that moves with respect to the fixed reference member with a basic period Pb defining a given number and duration of subperiods per passage of the reference with regard to the marks of the reference graduation, the two members of the pair each having a subperiod reading graduation, these two graduations being disposed according to the vernier principle, the subperiod reading graduations being disposed so that when the moving member is stopped in any position, the graduations allow a precise reading of a time interval corresponding to a subperiod fraction elapsed since a last coincidence between the position of the reference and a mark of the reference graduation, the arrangement of the subperiod reading graduations on the two members allows a reading of successive coincidences in the clockwise and counterclockwise direction independently of the rotational direction of the moving member.

2. The device according to claim 1, the moving member is provided, on one hand, with a principal reference that allows reading of the subperiods, and on the other hand, with a number of auxiliary references corresponding to the number of subperiods, and the fixed member of the pair comprises a graduation extending on a circular arc and including a number of fixed auxiliary references that correspond to a desired number of readable subperiod fractions, each reference of the moving member passing through the graduation of the fixed member so that when stopped, the position of an auxiliary reference in front of the fixed graduation allows reading of the elapsed subperiod fraction.

3. The device according to claim 2, wherein the reading pair comprises, on the moving member, an opaque circular crown that is subdivided into elements whose length is equal to the subperiods by transparent radial marks whose width corresponds to the subperiod fraction to be read, the fixed member of the pair comprises a crown disposed under the crown of the moving member and the fixed member crown having an arc portion divided into pairs of alternating dark or opaque and light elements, each pair of the dark and light elements covers an arc that corresponds to the subperiod marked by the moving member, the ratio between the dark and light elements varying from one pair to a following pair by an amount that corresponds to the subperiod fraction to be read.

4. The device according to claim 3, wherein the graduation of the fixed member of the pair extends on an arc that corresponds to a product of a desired number of readable subperiod fractions by a step of one subperiod on the moving member, and the number of pairs of light and dark elements also corresponds to the desired number of readable subperiod fractions in each subperiod.

5. The device according to claim 1, wherein the subperiod fractions are indicated on an auxiliary reading pair that is distinct from the principal reading pair, the indicator member of the auxiliary pair having a rotation period equal to a product of the duration of the subperiod of the principal pair and a desired number of readable subperiod fractions plus one or less one.

6. The device according to claim 5, wherein the members of the auxiliary reading pair each comprise a crown divided by radial elements into regular segments whose number is equal, for one of the members, to the number of subperiod fractions to be read, and for the other member, to that number plus or less one, the disposition being such that in every stopping position, the superposed and non-coinciding elements become invisible due to superposition of opaque or dark and of light or transparent portions, whereas only two coinciding elements, one of which is transparent and located on the moving member, and the other one of which is light and located on the fixed member, are visible and indicate by their position the duration of the subperiod fraction to be read.

7. The device according to claim 6, wherein the light or transparent portions have a width that corresponds to the duration of the subperiod fractions to be read.

8. The device according to claim 1, wherein the principal reading pair is composed of the indicator member and of the reference member for division of the period Pb into subperiods, the indicator member being provided with a single reference, and further comprising an auxiliary reading pair composed of an indicator member and a reading member that divide the subperiods into fractions, whose period corresponds to a sum of the number of subperiod fractions, and permit, when stopped during a subperiod, to read an elapsed time since a last coincidence between a reference of the fixed member and the reference of the moving member of the principal reading pair due to disposition of the subperiod reading graduations on the auxiliary reading pair.

9. Application of the device according to claim 1 in a mechanical chronograph, comprising a balance and spring system designed to operate at least at 28,800 vibrations.

10. Application of the device according to claim 9, wherein the chronograph comprises a direct-driven second-hand that rotates at one turn per minute, the indicator device being adapted to allow reading of tenths of seconds.

11. Application of the device according to claim 10, having a movement that comprises a driving mechanism for a wheel completing one turn in 9 or 11 seconds, and an auxiliary reading pair that forms a counter in a dial situated at 3 h., 6 h., 9 h. or 12 h.

12. Application of the device according to claim 1, wherein the indicator is incorporated in an analog watch, the pair of fixed and moving members having a decorative function.

* * * * *